US008931654B2

(12) United States Patent
Le Masurier et al.

(10) Patent No.: US 8,931,654 B2
(45) Date of Patent: Jan. 13, 2015

(54) CLOSURE DEVICE FOR A FLUID VESSEL

(75) Inventors: Steven Le Masurier, Jersey (GB); Stewart Humphrey, Jersey (GB); Darren Parsons, Lutterworth (GB)

(73) Assignee: Magicup Marketing Limited, Whetstone, Leicestershire (GB)

( * ) Notice: Subject to any disclaimer, the term of this patent is extended or adjusted under 35 U.S.C. 154(b) by 698 days.

(21) Appl. No.: 12/452,993

(22) PCT Filed: Jul. 31, 2008

(86) PCT No.: PCT/GB2008/002610

§ 371 (c)(1), (2), (4) Date: Apr. 8, 2010

(87) PCT Pub. No.: WO2009/016380

PCT Pub. Date: Feb. 5, 2009

(65) Prior Publication Data

US 2010/0206874 A1 Aug. 19, 2010

(30) Foreign Application Priority Data

Jul. 31, 2007 (GB) ..... 0714968.5

(51) Int. Cl.

| | |
|---|---|
| ***B65D 51/16*** | (2006.01) |
| ***A47G 19/22*** | (2006.01) |
| ***B65D 47/24*** | (2006.01) |

(52) U.S. Cl.

CPC ..... *A47G 19/2272* (2013.01); *B65D 47/24* (2013.01); *B65D 2313/04* (2013.01)

USPC ..... 220/203.09; 220/203.01; 220/719; 220/703

(58) Field of Classification Search

USPC ..... 220/203.01, 203.02, 203.03, 203.09, 220/203.28, 203.29, 703, 719

See application file for complete search history.

(56) References Cited

U.S. PATENT DOCUMENTS

| | | | | |
|---|---|---|---|---|
| 1,254,251 | A * | 1/1918 | Magnus | 220/719 |
| 2,675,815 | A * | 4/1954 | Dale | 137/43 |
| 3,360,161 | A * | 12/1967 | Smith | 220/719 |
| 3,730,399 | A * | 5/1973 | Dibrell et al. | 222/482 |
| 4,130,215 | A * | 12/1978 | Corey et al. | 220/719 |
| 4,394,928 | A * | 7/1983 | Philip | 220/373 |

(Continued)

FOREIGN PATENT DOCUMENTS

| | | |
|---|---|---|
| GB | 2264109 | 8/1993 |
| JP | 1029657 | 2/1998 |

(Continued)

OTHER PUBLICATIONS

English Abstract of JP 1029657.

*Primary Examiner* — Fenn Mathew
*Assistant Examiner* — Christopher McKinley
(74) *Attorney, Agent, or Firm* — Smith IP Services, P.C.

(57) ABSTRACT

A closure device (2) for a fluid vessel (1) comprises a bistable valve arrangement which includes first and second valve rim portions (4, 5) and a valve member (3) engageable with either of the rim portions (4, 5) respectively to define an open position in which fluid (9) can exit the vessel (1) and a closed position in which fluid (9) is substantially prevented from exiting the vessel (1). The valve is arranged to close automatically when an impulse is exerted against the valve member (3). This can occur for example when the vessel (1) is knocked over and the fluid (9) therein exerts pressure against the valve member (3).

17 Claims, 14 Drawing Sheets

(56) References Cited

U.S. PATENT DOCUMENTS

| | | | | | |
|---|---|---|---|---|---|
| 4,881,655 | A * | 11/1989 | Jansky et al. | 220/203.18 |
| 4,942,976 | A * | 7/1990 | Spencer | 222/153.14 |
| 5,246,124 | A * | 9/1993 | Battegazzore | 215/251 |
| 5,249,703 | A * | 10/1993 | Karp | 220/719 |
| 5,540,350 | A * | 7/1996 | Lansky | 220/380 |
| 5,573,139 | A * | 11/1996 | Yeh | 220/360 |
| 5,979,689 | A * | 11/1999 | Lansky | 220/255 |
| 6,199,711 | B1 * | 3/2001 | Lansky | 220/255 |
| 6,305,571 | B1 * | 10/2001 | Chu | 220/719 |
| 6,619,492 | B2 * | 9/2003 | Battegazzore | 215/21 |
| 6,702,145 | B2 * | 3/2004 | Malcolm | 220/713 |
| 7,017,768 | B2 * | 3/2006 | Iskierka | 220/216 |
| 7,100,790 | B2 * | 9/2006 | Dark | 220/711 |
| 7,513,380 | B2 * | 4/2009 | Canedo | 220/230 |
| 7,950,541 | B2 * | 5/2011 | Holcomb et al. | 220/203.21 |
| 2002/0003145 | A1 * | 1/2002 | Milan | 220/713 |
| 2002/0179637 | A1 * | 12/2002 | Doron et al. | 222/108 |
| 2003/0029890 | A1 | 2/2003 | Olechowski et al. | |
| 2004/0232154 | A1 * | 11/2004 | Smith et al. | 220/713 |
| 2005/0230403 | A1 * | 10/2005 | Dark | 220/711 |
| 2006/0226146 | A1 | 10/2006 | Haberman | |

FOREIGN PATENT DOCUMENTS

| | | |
|---|---|---|
| WO | 9414588 | 7/1994 |
| WO | 9910247 | 3/1999 |
| WO | 0197663 | 12/2001 |
| WO | 2007008760 | 1/2007 |

* cited by examiner

CLOSURE DEVICE FOR A FLUID VESSEL

BACKGROUND OF THE INVENTION

1. Field of the Invention

The present invention relates to closure mechanisms for fluid vessels, and particularly to non-spill drinking vessels.

2. The Prior Art

Various closure mechanisms for fluid vessels are known in the prior art. For example, WO0197663 discloses a spill-proof closure and cup, comprising a closure assembly for fitting to an open-ended drinking vessel including a lid with a spout. The spout has a valve including a flexible portion openable to allow a flow of fluid when a pressure differential is applied to the spout by sucking thereon. In the absence of a pressure differential, the flexible portion shuts off the valve.

U.S. Patent Appln. Publication 2006/226146 discloses a drinking vessel comprising a cup and lid portion including a closure flap, which is deflectable by means of an operating handle hingedly supported on the lid to open a fluid outlet. The closure flap is resilient so that it returns to its closed position when pressure is released from the operating handle.

U.S. Patent Appln. Publication 2002/0179637 describes a safety device for a liquid-containing vessel, such as a kettle. A flap is hinged to the vessel and arranged to cover and close a fluid opening 36 when fluid presses on the flap. The flap comprises a magnet which is attracted to magnets in the region of the opening, such that the flap remains held in the closed position unless an external influence acts to open the flap. The vessel does not comprise a means for holding the flap in the open position and when pouring from the vessel, a user must continuously apply a force to the flap to hold the flap in the open position.

With the prior art devices, each time the user wishes to take a sip from the vessel, it is necessary to apply an opening force to the closure assembly, whether this force be from suction or a manually applied force, in order to allow fluid to exit the vessel. In the absence of the opening force, the closure assemblies automatically revert to the closed position.

SUMMARY OF THE INVENTION

The present invention provides a closure device for a fluid vessel, the closure device including a bistable valve having a valve member having an open position in which fluid can exit the vessel and a closed position in which fluid is substantially prevented from exiting the vessel, wherein the closure device includes a means for exerting a force on the valve member which holds the valve member in the open position and the bistable valve is arranged to close in response to fluid inside the vessel pressing against the valve member so as to overcome the force exerted by the means.

It is possible for the closure mechanism to effect a partial closure rather than a full closure of the valve when the mechanism is in the closed position. This would still allow fluid to exit the vessel but at a reduced rate compared with the flow rate possible when the valve is in the open position.

By virtue of the valve being bistable, it remains in the open or closed position until an external influence alters its position. This means that it is not necessary to actuate any opening handle or to suck on a spout, for example, each time it is wished to take a sip from the vessel. The present invention therefore conveniently allows a user to drink from the vessel in much the same way as if drinking from a standard open-topped cup. In particular, with the invention it is possible to allow fluid to exit the vessel at any position around the rim and there is no need for the user to align a spout with their mouth.

This makes the invention suitable for use by all age groups and not just toddlers. The device could be used for training toddlers how to drink from a normal open-topped glass. It is envisaged that the invention will be of use to many different groups, for example it could be used as a travel cup, a camping mug, a disability beaker and a children's cup etc. the invention could also be embodied in disposable form. The device is equally usable with both hot and cold drinks.

The closure device can also be applied to any vessel where it is desirable to guard against spillage. This includes fuel cans, vessels for use in a laboratory, pharmacy or medical environment, vessels for use in industrial or manufacturing processes, vessels for use in the home such as cleaning products and toiletries and numerous other applications which a skilled person would know to apply the benefit's of this device to. The applications' illustrated herein are for small-scale devices however it is also possible to use the closure device with larger scale devices such as containers used to transport, store or dispense fluids on an industrial scale.

The closure device can also be applied to a dispensing device wherein the outflow point from a vessel is on the underside or side part of a vessel. A user could place a receiving vessel underneath the closure device and open the device to a full extent when the device would be held in the open position and flow could, for example, be measured out. The closure device could alternatively be opened to a lesser extent to permit outflow from the vessel without fully opening the valve holding the valve in an intermediate position where fluid outflow could be more controlled by a user.

Advantageously, the valve can be arranged to close automatically when an impulse is exerted against a valve member of the valve. When the vessel is accidentally knocked over from its standing position or is dropped, the fluid contained in the vessel will naturally tend to move chaotically inside the vessel and push against the closure mechanism, and the bistable valve is adapted to move from the open position to the closed position under the influence of this force. Equally, if the user decides deliberately to close the valve, one way in which this can be done is by shaking the vessel and closure assembly briefly in one direction, whereby the inertia imparted to the closure assembly acts to close it. To close the valve, the force exerted by fluid inside the vessel on the valve member must be greater than or equal to a predetermined force in order to overcome a force on the valve which holds the valve member in the open position.

The valve is preferably a unitary moving part, whereby the construction of the device is simple so there is a low likelihood of mechanical failure, compared to prior art devices utilising hinged mechanisms for example.

Advantageously, if the vessel contains a hot fluid and the closure device is in the closed position, a pressure build up caused by hot air within the vessel expanding will not cause any adverse effects. A pressure build-up will not act to open or weaken the valve, rather it will act in the same direction as the valve, complimenting the valve mechanism. The closure device is also comprised of parts whose dimensions will not alter under pressure or heat so as to affect the valve properties. The vessel itself can be made of a more resilient material which may expand in certain regions when a hot fluid is within the vessel. A further advantage of the closure device is that the valve can be opened easily by a user if the valve is pressurised by hot air within the vessel. The large surface area of the valve body enables a user to apply an opening force over a large area of the vessel itself. An aperture provides access to the valve member for a user. An aperture may be comprised by the closure device and/or the vessel. Such benefits could prove especially advantageous were the closure device to be employed on portable vessels containing hot beverages.

If a pressure build up was greater than desired, the closure device can be realised in such a way that a pressure relieving or releasing means can easily be incorporated into the closure device or a vessel with which the closure device were to be associated.

Further advantageous optional features of the invention are set out in the sub-claims.

BRIEF DESCRIPTION OF THE DRAWINGS

There now follows a detailed description of embodiments of the invention by way of example with reference to the accompanying drawings, in which.

DETAILED DESCRIPTION OF THE PREFERRED EMBODIMENTS

Figure 1:
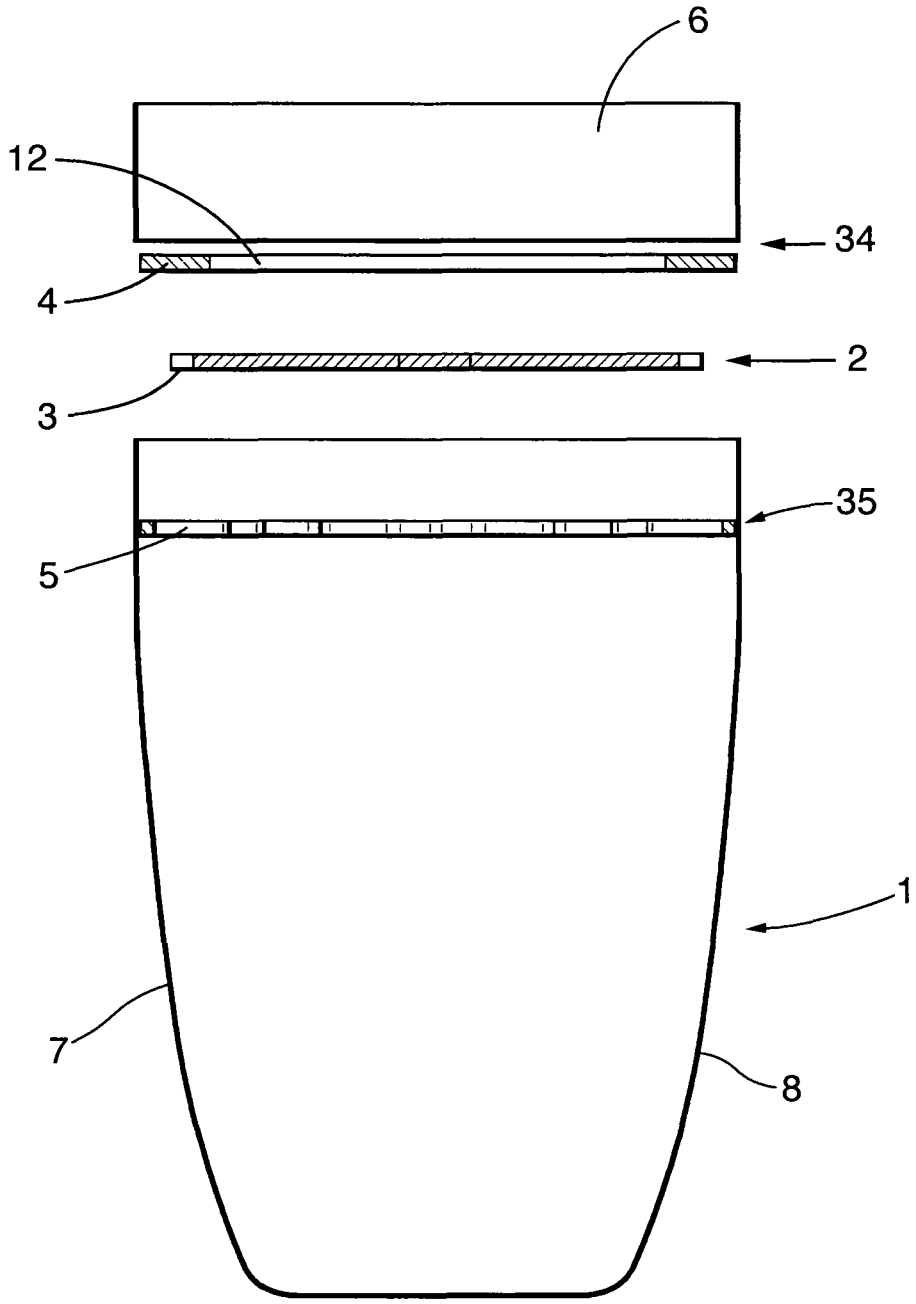
FIG. 1 is a partially exploded side elevation of a closure device and vessel according to a preferred embodiment of the invention.

FIG. 1 shows a closure device 2 and vessel 1, including a main vessel part 7 for holding a fluid and a removable lid or rim part 6 for direct application to the user's mouth. The rim part 6 is readily removable from the vessel to allow the vessel to be easily filled and/or cleaned, although these operations could be carried out with the rim part 6 in place. A push-on flange (not shown) extending around the circumference of the vessel can be used to secure the rim part 6 to the main vessel part 7. Alternatively, the rim part 6 and the main vessel part 7 can be attached to one another by a threaded connection.

The closure device 2 comprises a bistable valve including a valve member 3, in the form of a valve disc, and a first and a second valve seat 34, 35 comprising first and second valve rim portions 4,5. The valve member 3 is movable between the first and second valve rim portions 4,5 and when engaged therewith defines respectively the closed and open positions of the valve. When the vessel is upright, the first valve rim portion 4 is situated above the second valve rim portion 5. Therefore, in order to open the valve, a downward force, or a force towards the inside of the vessel 1 is required to act on the valve member 3, and in order to close the valve, a force in the opposite direction, i.e. away from the inside of the vessel 1 is required. In this way, the valve can be opened by depressing the valve member 3 when it is desired to drink from the vessel 1. It is possible to arrange the valve member 3 so that it can be depressed by the user's nose or lip for example when taking a sip from the vessel 1. Advantageously, the valve member 3 can be constructed as unitary moving part.

Figure 2:
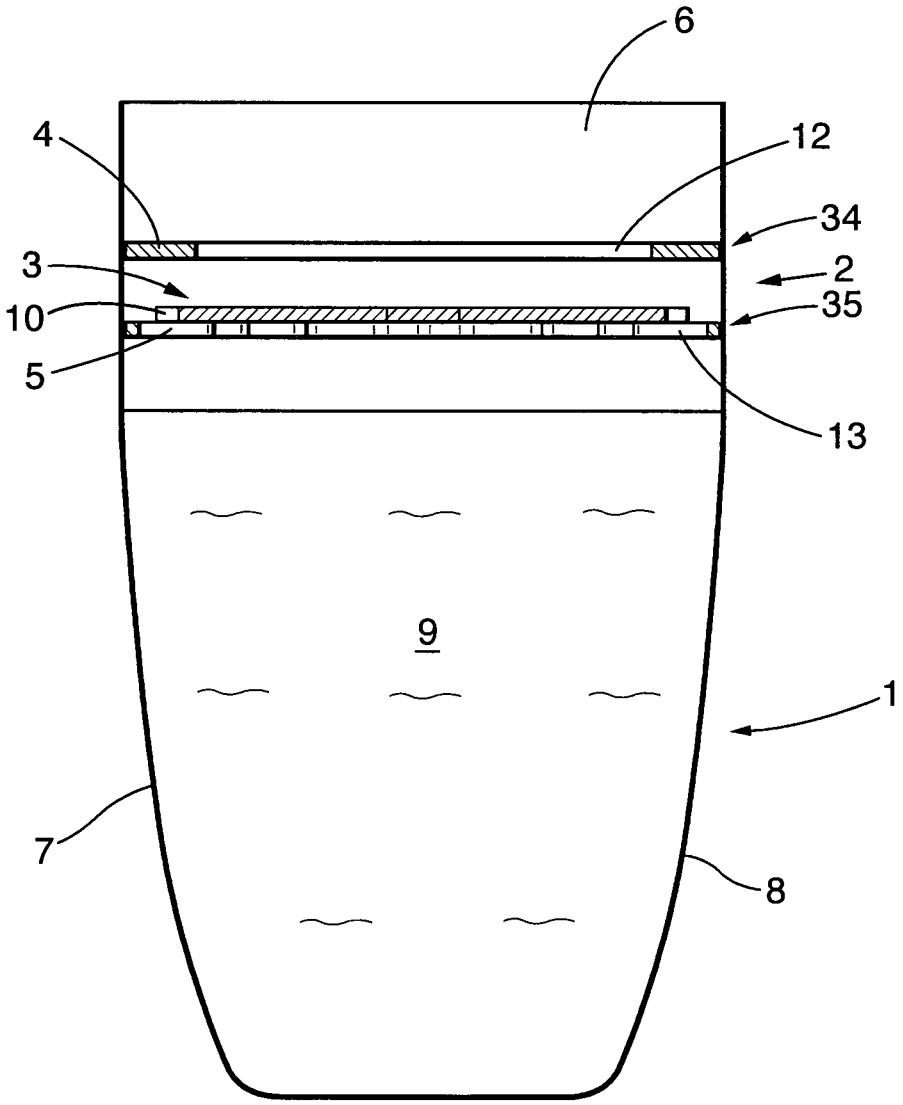
FIG. 2 is a side elevation of the closure device and vessel shown in FIG. 1 wherein a valve of the closure device is open.

FIG. 2 shows the closure device 2 and vessel 1 of FIG. 1 with the valve disc 3 in the open position, i.e. engaged with the second valve rim portion 5. The valve member 3 includes a number of perforations 10, and the valve rim portion 5 is dimensioned so that fluid 9 may flow through gaps defined by the perforations, as shown more clearly in FIG. 5.

Figure 3:
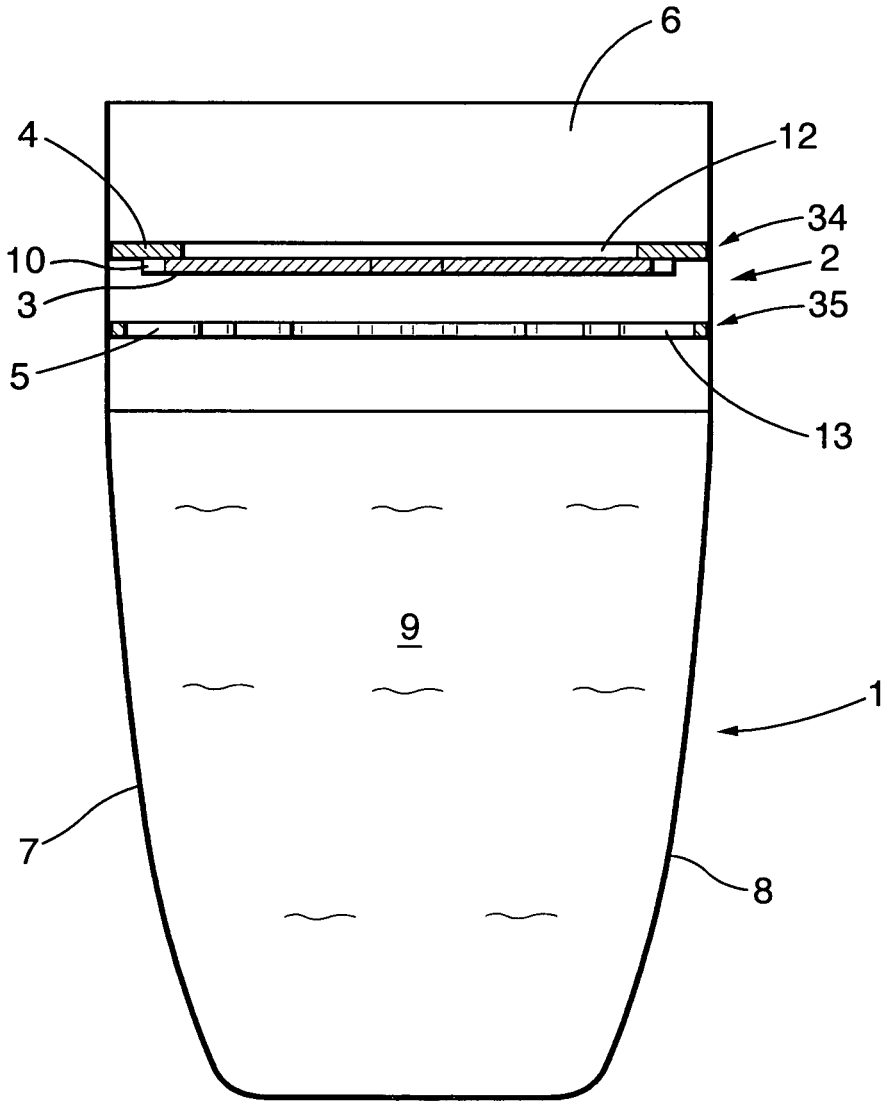
FIG. 3 is a side elevation of the closure device and vessel shown in FIG. 1 wherein a valve of the closure device is closed.

FIG. 3 shows the closure device 2 and vessel 1 of FIG. 1 with the valve member 3 in the closed position, i.e. engaged with the first valve rim portion 4. The dimensions of the first valve rim portion 4 are such that the perforations around the periphery of the valve disc are closed off when the valve member 3 engages with the first valve rim portion 4 and so no fluid can escape.

The first and second valve rim portions 4,5 include at least one magnet to hold the valve disc in position. Preferably the valve rim portions 4,5 are made from a magnetic material, such as a plastics material impregnated with magnetic material and the valve disc is made from a metallic material capable of being attracted to the magnets. It is possible for just the upper valve rim portion 4 to be magnetized to hold the valve member 3 in the closed position, and to rely on gravity to hold the valve member 3 against the lower valve rim portion 5 when the valve is open but such an arrangement is not within the scope of the present invention. Instead of magnetic means for holding the valve disc 3 in place, mechanical means such as a latching mechanism can be utilised.

Figure 4:
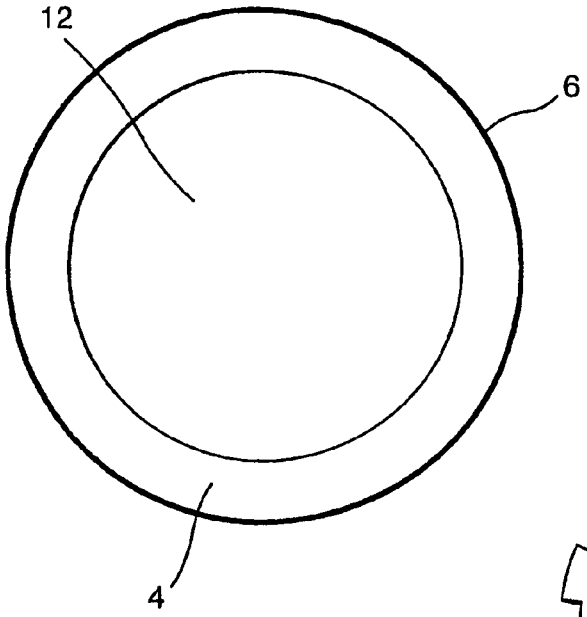
FIG. 4 is a top plan view of a valve part.

FIG. 4 shows the first valve rim portion 4 in plan view, nested within the rim part 6 of the vessel 1. The valve rim portion 4 can be integrally formed with the vessel rim part 6 or the valve rim portion 4 can be formed separately and affixed thereto. The valve rim portion 4 defines a central circular aperture 12 through which fluid passes when the valve is open. The valve rim portion may comprise or be at least in part comprised by a gasket or seal.

Figure 5:
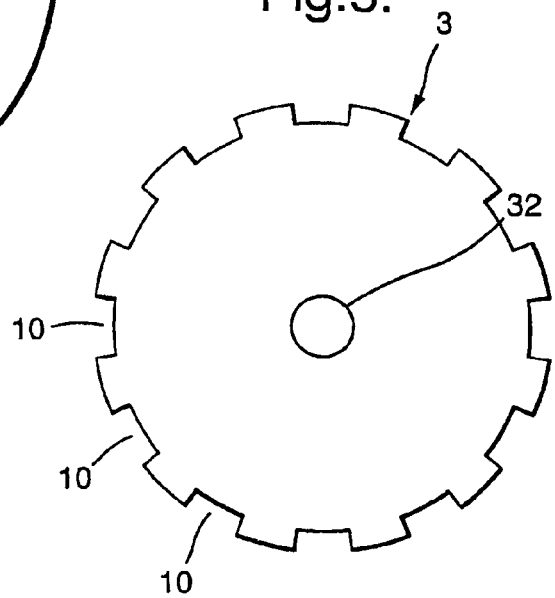
FIG. 5 is a top plan view of another valve part.

FIG. 5 shows the valve member 3 in plan view including the perforations 10 distributed evenly around the periphery of the member 3. The valve member 3 may also include a pressure releasing means 32, such as a safety valve.

Figure 6:
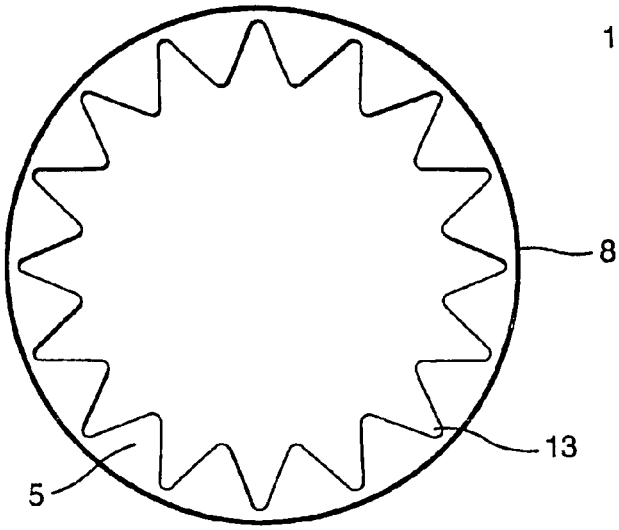
FIG. 6 is a top plan view of further valve part.

FIG. 6 shows in plan view the second valve rim portion 5 nested within the walls 8 of the main vessel part 7. Preferably, the valve member 3 is retained more firmly in the closed position than in the open position, to ensure that when the device is closed, it remains closed, until the user decides to open it, and helping to avoid leakage from the vessel. Further, the force required to hold the valve member 3 in the open position is optimized to make sure that when the user drinks from the vessel, this action does not cause the valve to close, but the force holding the valve open should be weak enough so that if the vessel is knocked over or dropped, the valve member 3 is pushed into the closed position. One way of achieving this magnetically is to make the second valve rim portion 5 magnetically weaker than the first valve rim portion 4. In the example shown, this is achieved by forming the second valve rim portion 5 with less magnetic material than the first valve rim portion 4, in particular using a saw tooth configuration for the second valve rim portion 5. An aperture 13 is defined by the second valve rim portion 5 through which fluid may pass when the valve is open. The valve member 3 is constructed such that this aperture is not closed when valve member 3 is seated on valve rim portion 5 when the device is in the open position.

An alternative construction of the valve rim portions, not shown in the drawings, utilizes one or more magnetic bands arranged around the inner periphery of the vessel, into which the valve disc can fit, rather than abutting against the valve rim portions as it does in the above embodiment. An additional flange can be provided below and/or above the magnetic band or bands to prevent the valve disc falling out of the closure device.

Figure 7:
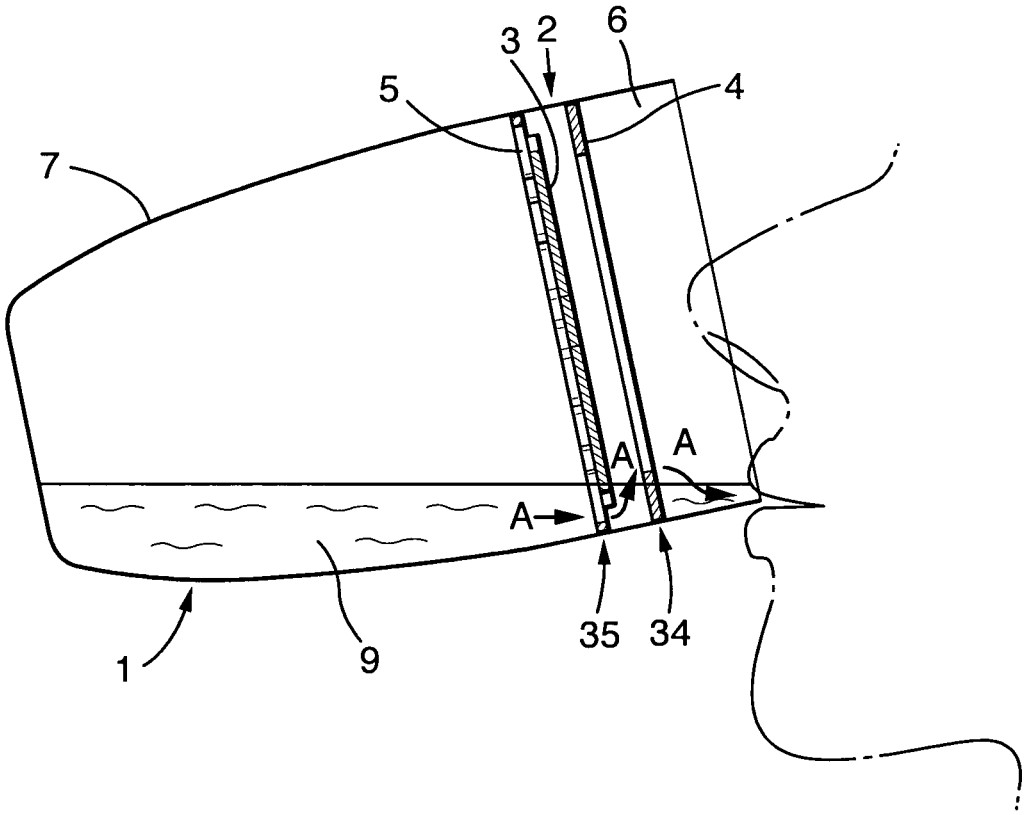
FIG. 7 is a side view of the closure device and vessel shown in FIG. 1.

FIG. 7 illustrates the closure device 2 and vessel 1 of FIG. 1 with the valve member 3 in the open position, wherein the vessel is inclined and a user is drinking therefrom. Arrows A show the path which fluid takes to exit the vessel. Firstly, the fluid passes through the aperture 13 of the second valve rim portion 5 and between the perforations 10 of the valve member 3. The fluid then passes through the aperture 12 defined by the first valve rim portion 4 and over the vessel rim part 6 into the user's mouth.

Figure 8:
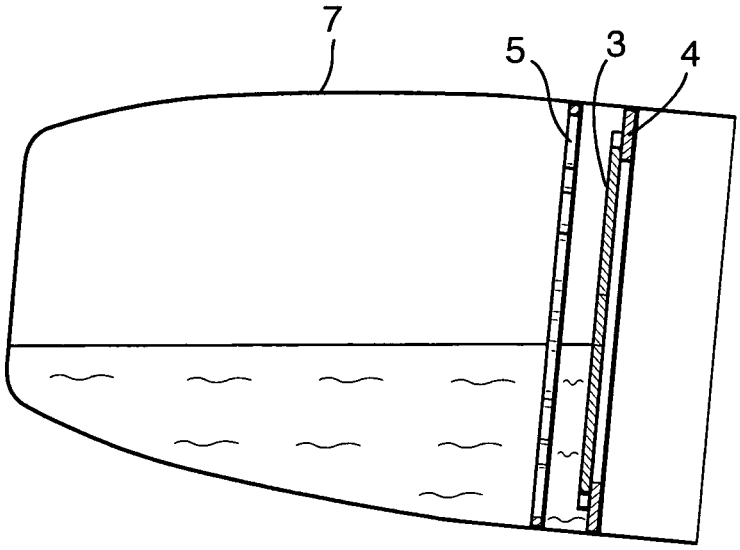
FIG. 8 is a further side view of the closure device and vessel shown in FIG. 1.

As shown in FIG. 8, the strength of the magnet in the second valve rim portion 5 can be chosen such that if the user inclines the vessel beyond a certain angle to the vertical, depending on the quantity of fluid that is inside the main vessel part 7, the valve member 3 can move into the closed position under the fluid pressure. Equally, if the device is dropped or knocked over, the fluid pressure will move the valve member 3 into the closed position. The valve can also be constructed so as to close when a user shakes the vessel. The device can be reopened by simply depressing the valve member 3.

Figure 9:
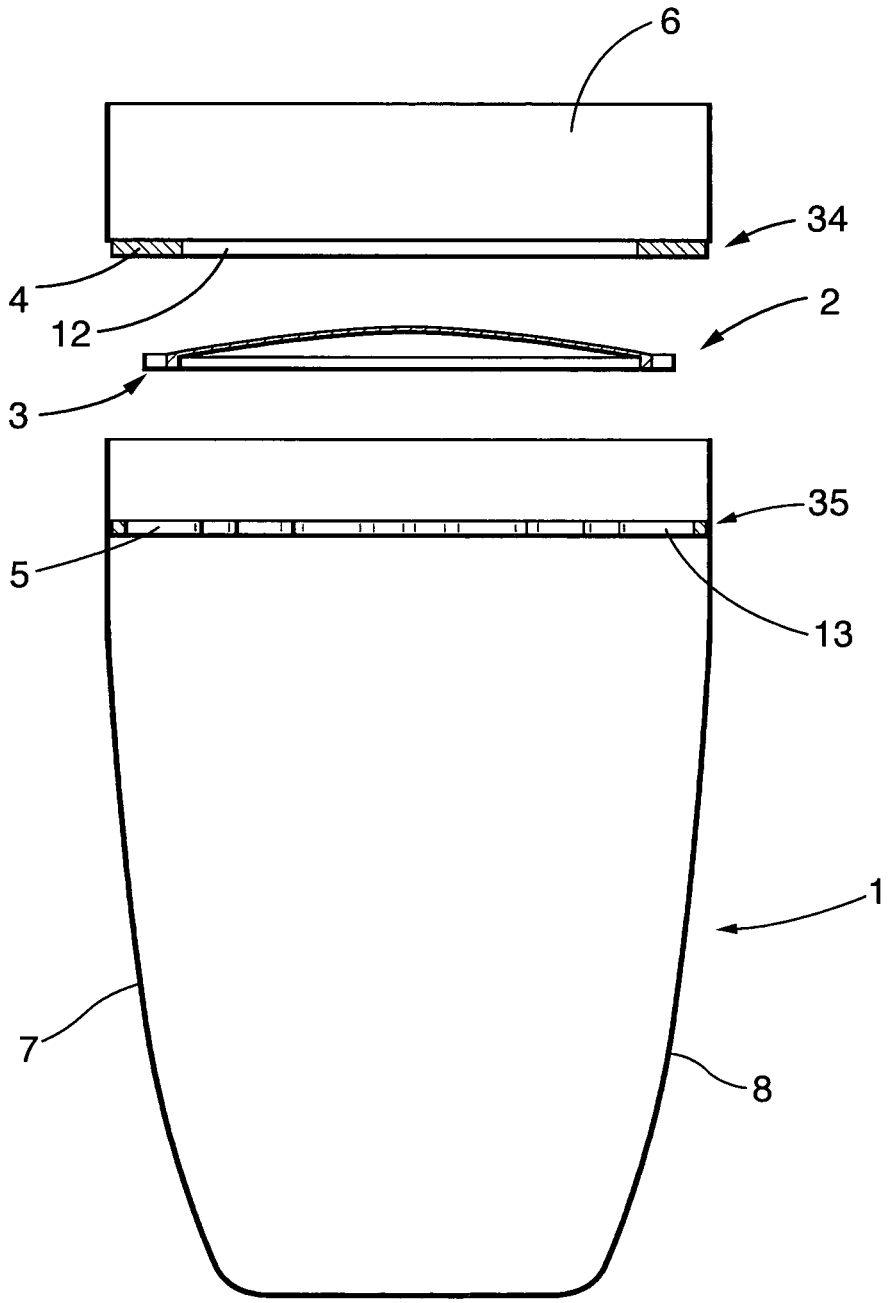
FIG. 9 is a partially exploded side elevation of a closure device and vessel with a different valve body to that shown in FIG. 1.

FIG. 9 shows a variation on the valve member 3, wherein a dome-shaped protrusion is provided on the upper surface of the valve member 3. The protrusion 14 helps to guide any residue of fluid within the closure device back into the main part 7 of the vessel. Further, the protrusion 14 can act as a button facilitating the depression of the valve member 3 by the user.

Preferably, the surface 8 of the main vessel part 7 has a curved surface profile. By virtue of this feature, fluid currents occurring when the vessel is knocked over are damped, which reduces the amount of water escaping through the valve before it actually seals shut.

Figure 10:
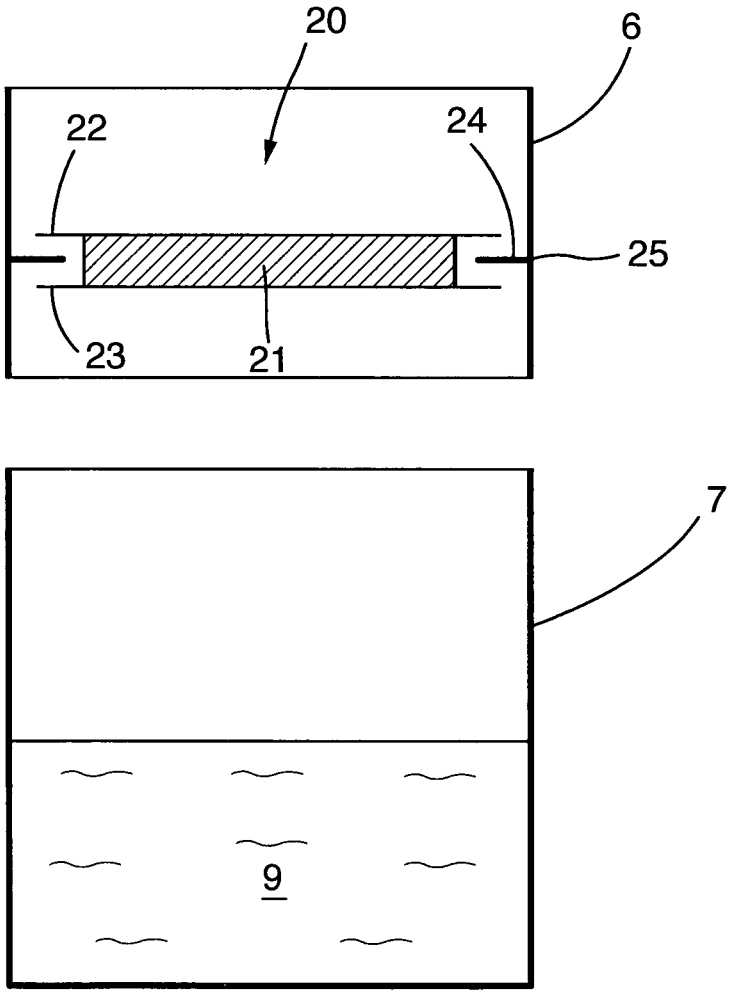
FIG. 10 is a side elevation of a second embodiment of a closure device and vessel according to the invention.

FIG. 10 shows a different embodiment of the closure device, wherein the valve member comprises first and second motion limiting elements 22, 23 connected to one another and engageable with the valve seat 25 which comprises a valve rim portion 24. The first motion limiting element 22 is arranged above the second motion limiting element 23 when the vessel is upright, and in the open position of the valve, the first motion limiting element engages the valve rim portion 24. The second motion limiting element is arranged below the first motion limiting element, and in the closed position of the valve engages the valve rim portion 24.

The first motion restricting element 22 includes a series of perforations around its periphery, which allow fluid to pass therethrough when the first motion restricting element 22 is in contact with the valve rim portion 24.

The device according to FIG. 10 works in much the same way as the device shown in FIGS. 1 to 9, with the difference that instead of providing two valve rim portions and a valve member, preferably in the form of a flat valve disc, there is only one valve rim portion and two disc elements on the valve member. The two disc elements can be connected to one another by a spindle 21.

Figure 11:
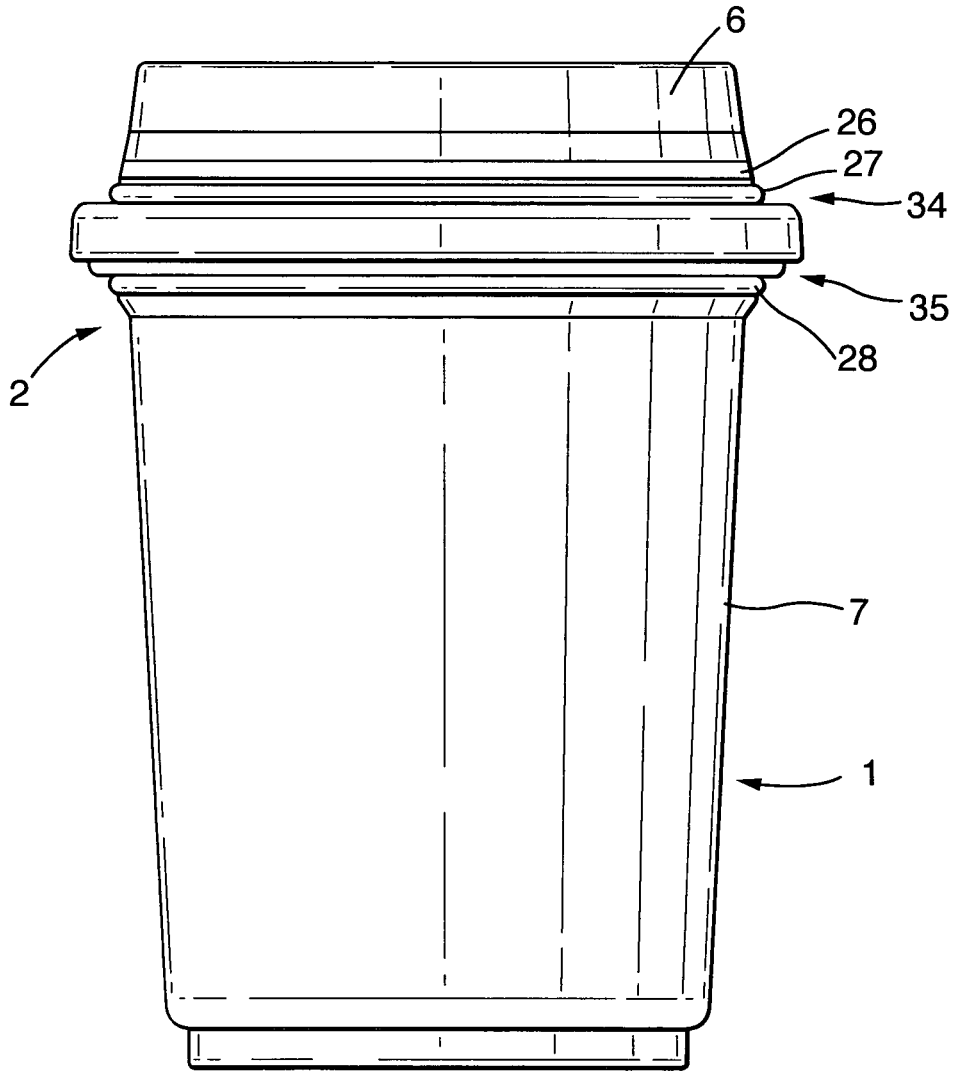
FIG. 11 is a side view of a third embodiment of a closure device and vessel according to the invention.

FIG. 11 shows a further embodiment of the closure device according to the invention, including a main vessel part 7 for holding the fluid and a rim part 6 which forms an upper lid of the vessel. The rim part 6 is readily removable from the vessel to allow the vessel to be easily filled with fluid and/or cleaned, although these operations could be carried out with the rim part in place.

The closure device 2 comprises a bistable valve with a valve member 3 (not shown in FIG. 11) and first and second valve seats 34,35. The first valve seat 34 is comprised by the rim part 6 and the second valve seat 35 is comprised by the main vessel part 7. The closure device also comprises a seal or gasket 26 which closes the path which fluid would take to exit the vessel when the valve is in the closed position. The seal 26 forms an important component of the first valve portion 4. The operation of the device will be further explained with reference to FIGS. 12 to 17.

Figure 12:
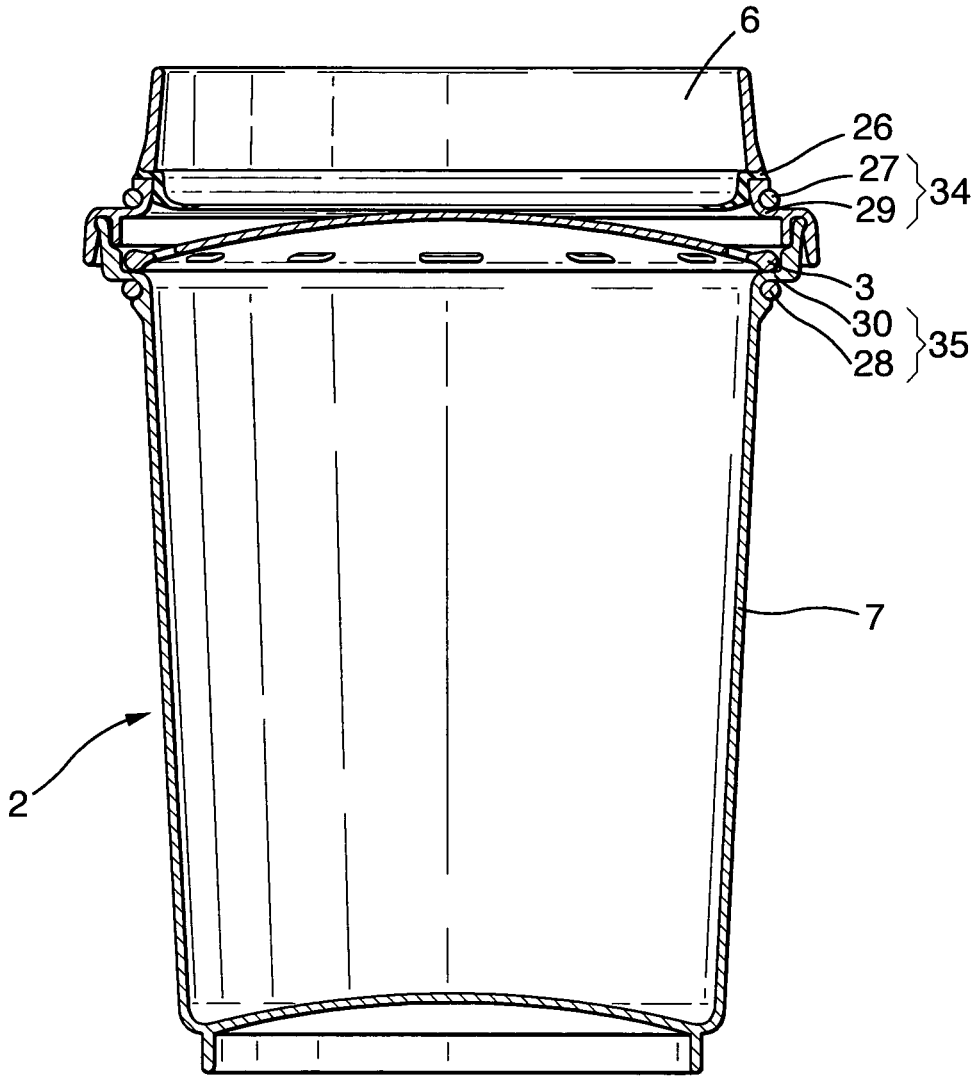
FIG. 12 is a cross-section of a front view of a closure device and vessel shown in FIG. 11 in the open position.

FIG. 12 shows a cross-sectional perspective view of the closure device seen in FIG. 11 in the open position.

The valve member 3 is held in position against the second valve seat 35. Valve seat 35 is comprised of a ring 28, located at least partially in a groove which extends around the circumference of the exterior of the main vessel 7. It is alternatively envisioned that the first valve seat 34 is located on the main vessel part 7 or that the second valve seat 35 is located on the rim part 6 however this is not shown in the drawings. Valve seat 35 also comprises a valve rim or flange 29 against which the valve member 3 abuts when in the closed position. The rim 29 is formed at least partially around an inner circumference of an interior part of the vessel 1. Rim 29 defines a lower limit stop which derives a maximum extent of movement for valve member 3.

Valve member 3 is held in the closed position by means of a magnetic force. Ring 28 can be comprised by a material which is attracted to magnets, such as steel. In this case, valve member 3 is comprised by or comprises a material which exerts a magnetic force of attraction towards ring 28. Alternatively, the ring 28 could also comprise or be comprised by a material which is also capable of generating a magnetic force of attraction. In this case, the valve member 3 may instead be comprised of a material which is attracted by a magnetic force, or may also be comprised of a magnetic material which generates a magnetic force of attraction.

The magnetic attraction between the ring 28 and valve member 3 is present, even though the valve rim portion 30 is arranged between the ring 28 and the valve member 3. An advantage of the rings 27, 28 being located on the outside of the vessel 1 is that they do not come into contact with fluid inside the vessel 1.

If the vessel is knocked over, the inside fluid will be knocked onto the valve member 3 and the force of the fluid on the member will act against the magnetic force of attraction between the ring 28 and the valve member 3. The size of the attractive force is such that if a user drinks from the cup, the fluid force on the valve member is not great enough to overcome the magnetic force of attraction, but if the cup is knocked over, the force will be great enough to overcome the attractive force and move the valve member from the valve seat 35 towards the opposite valve seat 34.

Figure 13:
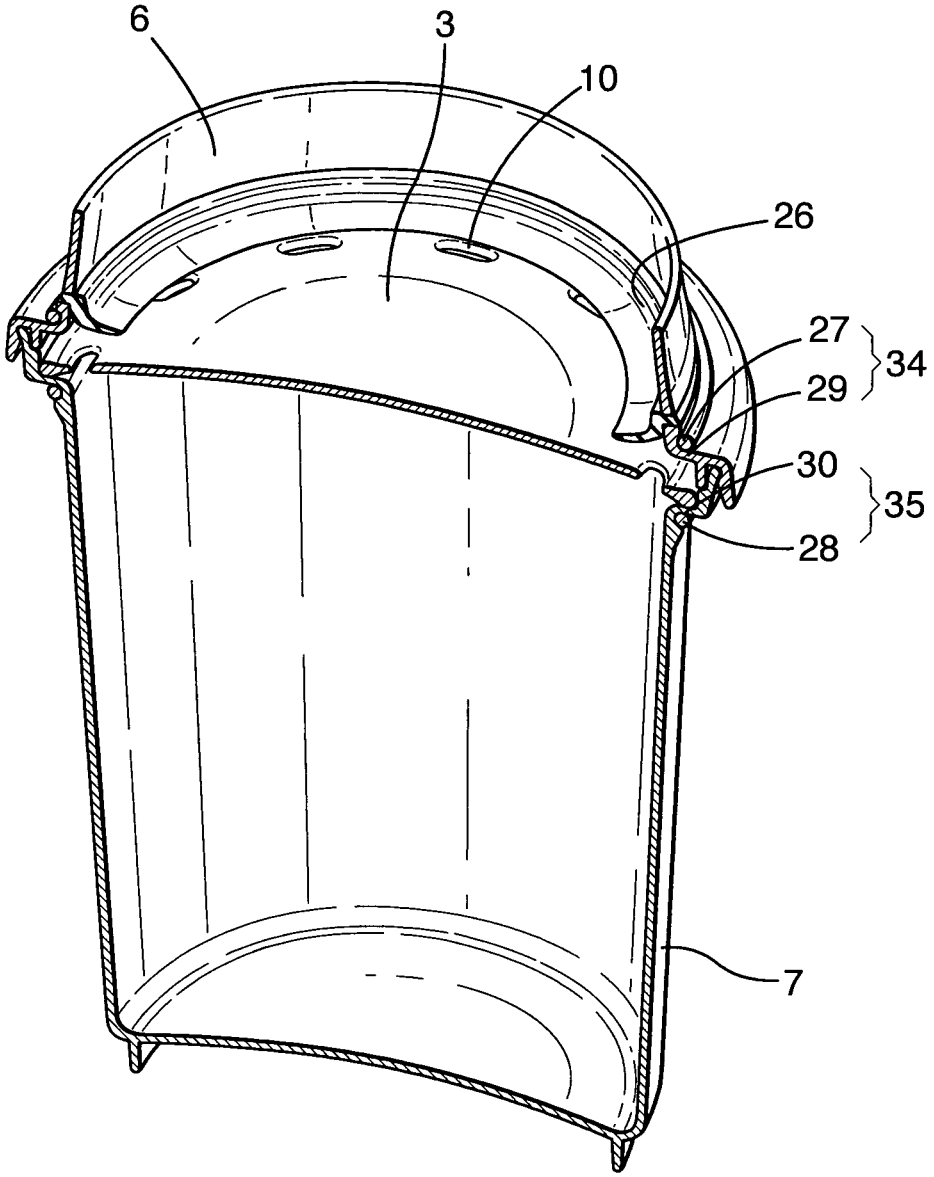
FIG. 13 is a cross-section of a perspective view of a closure device and vessel shown in FIGS. 11 and 12 in the open position.

FIG. 13 shows a perspective view of the closure device in the open position, as seen in FIG. 12. Fluid can flow out of the vessel, for example when a user wishes to drink from the vessel, since valve member 3 comprises a number of perforations 10, located around the periphery of the valve member 3 through which fluid can flow. The part of valve member 3 which is in contact with the valve seat 35 does not include the perforations 10 so fluid flow is unobstructed.

Figure 14:
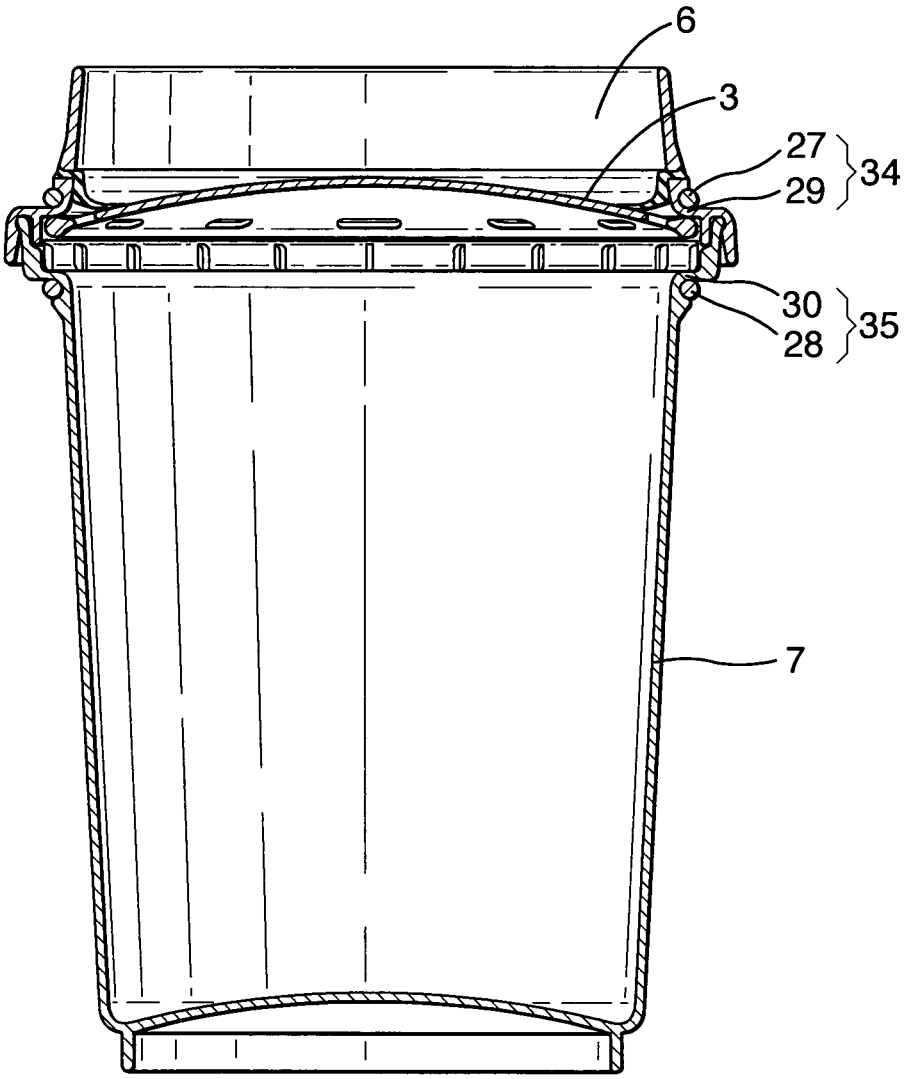
FIG. 14 is a cross-section of a front view of a closure device and vessel shown in FIGS. 11 to 13 in the closed position.

FIG. 14 shows the device in the closed position. Valve member 3 is held in position against the first valve seat 34 by a magnetic force of attraction between valve ring 27 and valve member 3. Valve seat 34 can have the same properties or features as previously described in relation to valve seat 35. Valve rim or flange 29 is formed by an inner part of the valve rim 6 against which valve member 3 engages when held in the closed position. Alternatively, the first valve seat 34 could be arranged in the main vessel 7 (not shown) as long as the first valve seat is located above the second valve seat when the vessel is in the upright position.

Figure 15:
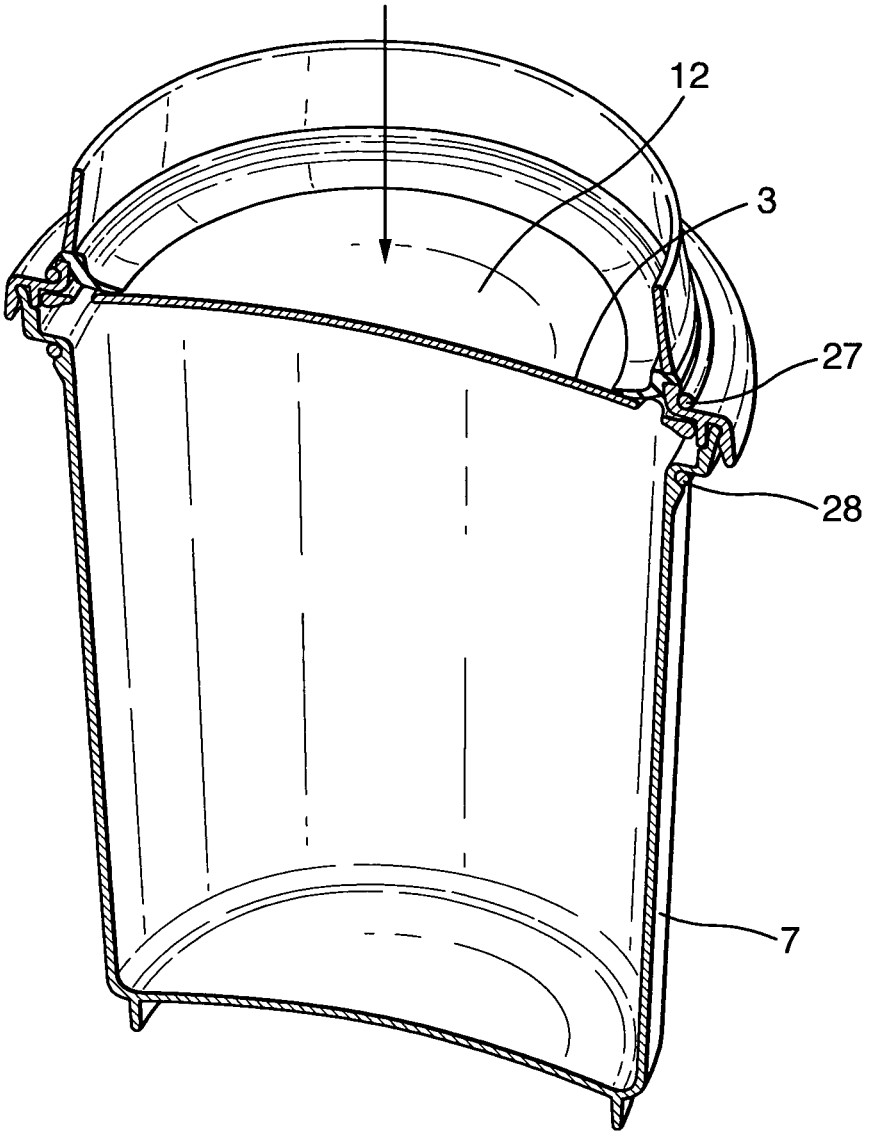
FIG. 15 is a cross-section of a perspective view of a closure device and vessel shown in FIGS. 11 to 14 in the closed position.

The closure device comprises a seal or gasket 26 located above the first valve seat 34. The seal is arranged such that when the valve member is in the closed position, the perforations 10 in the valve member 3 are covered by the seal such that fluid paths out of the vessel are closed. It is alternatively envisioned that the seal could only partially cover the perforations (not shown) so that in the closed position, a level of flow can still exit the vessel. A comparison of FIGS. 13 and 15 shows that when the closure device is in the open position (FIG. 13) the perforations 10 in the valve member 3 are unobstructed so fluid can exit the vessel 1. In FIG. 15, the seal 26 covers the perforations so fluid cannot exit the vessel 1.

Figure 16:
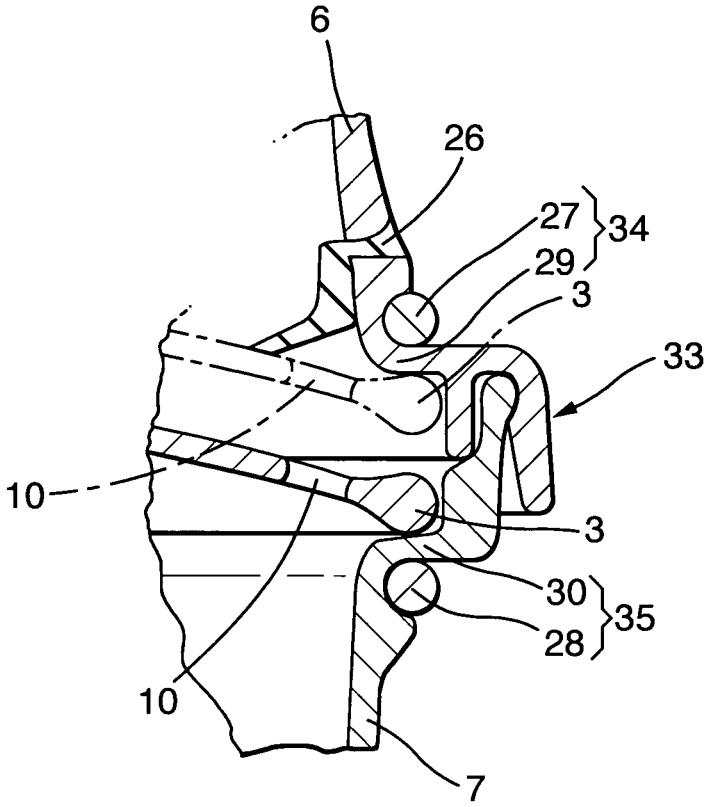
FIG. 16 is a cross-sectional view of part of the closure device.

FIG. 16 provides a zoomed-in view of part of a cross-section of the closing device.

Valve member 3 is seen in both the open and the closed positions, with the member shown in dotted lines in the closed position. In the open position, valve member 3 rests on the second valve rim 30. The magnetic force of attraction between the valve member and the ring 28 holds the valve member in position. Fluid can leave the vessel through perforations 10, at the circumferential location indicated on the figure. In the open position, valve member 3 abuts the first valve rim 29. The magnetic force of attraction between the valve member 3 and the ring 27 holds the valve member in the open position. Seal 26 is located above the first valve seat 34 and engages with the valve member 3, blocking the path which fluid could otherwise take from the interior of the main vessel part 7 out of the vessel.

The vessel 1 is shown to be comprised by a room or lid part 6, secured to the main vessel part 7 by a snap-fit connection 33. The rim part 6 is removable. Other forms of attachment are possible which are not shown here, such as a threaded connection.

To open the vessel from the closed position seen in FIGS. 14 and 15, a user can apply a force to valve member 3 through an aperture 12 in the top of the vessel which allows a user access to the valve member 3. The valve member 3 can be pushed by a user towards the open position where it sits against the second valve seat 35, if the user pushes hard enough to overcome the magnetic force of attraction between the valve member 3 and the ring 27. The direction in which a user would push to open the closure device is indicated by an arrow on FIG. 15.

The valve body 3 could be retained more firmly in the open position than the closed position. This could be achieved by having a lesser thickness of the inner rim 28 than the inner rim 29.

Figure 17:
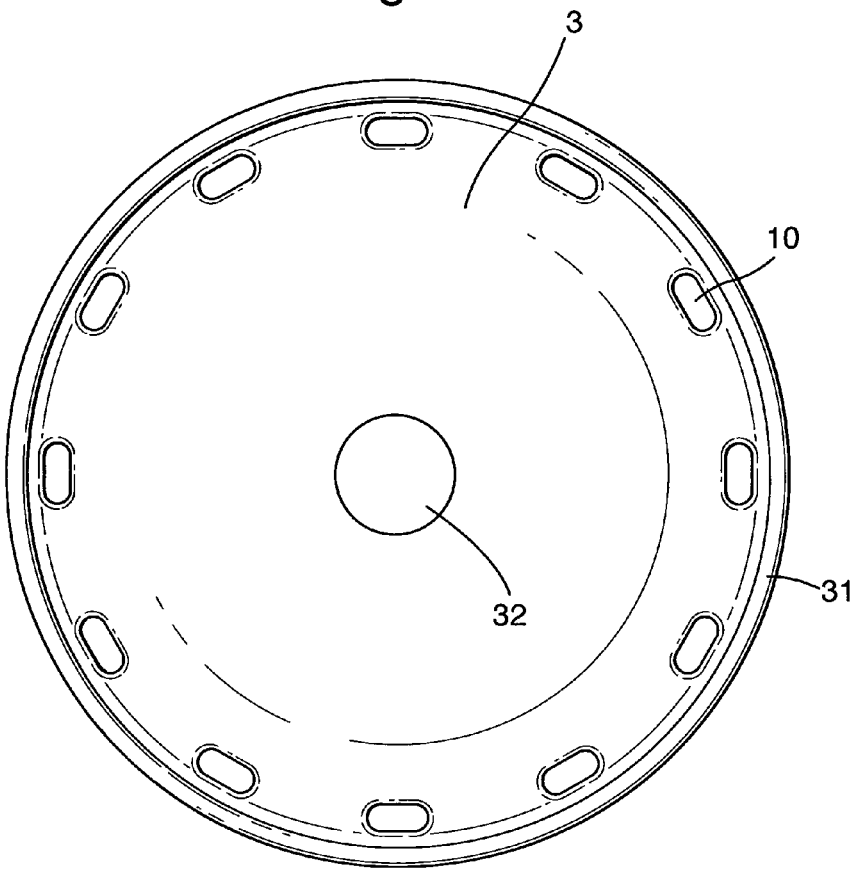
FIG. 17 is a top plan view of a valve part.

FIG. 17 illustrates the valve member 3 of FIGS. 11 to 15 in the form of a disc. Perforations 10 are equally spaced around an outer circumference of the disc within a main area of the disc. An irregular spacing of the perforations is also possible. The valve member 3 also has a raised rim 31 surrounding the periphery of the disc which abuts against the first and second valve rim portions 4,5 when the valve is in the open and closed positions respectively. The valve member 3 can be made of a plastics material impregnated by magnets. A pressure-releasing means 32 can be located on the disc. This member could be located off-centre of the valve member alternatively (not shown). This means may be a safety valve.

Figure 18:
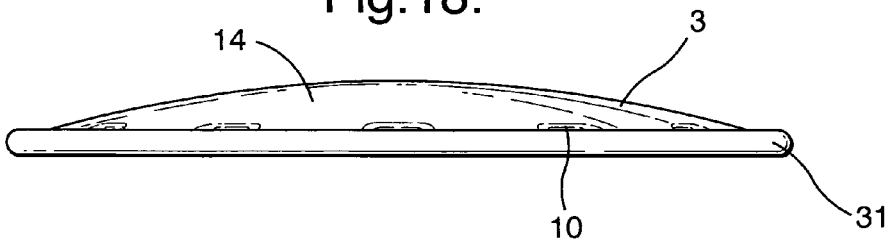
FIG. 18 is a side view of a valve part.

FIG. 18 also illustrates the valve body. The raised rim 31 can be seen as well as a protrusion 14 on the upper surface of the disc. The protrusion is dome-shaped.

It is possible to provide a locking position of the closure device, in which the valve is locked open or closed. This can be effected using lugs within the closure device which can lock the valve body in place for example by rotating the valve body into engagement with the lugs.

The closure device may also be fully located within the rim part, wherein the rim part forms an upper lid of a vessel, removable from the main vessel.

The vessel may comprise, at least in part, a flexible material which expands when a hot fluid is located within the vessel. The sides of the main vessel could take a concertina-like form to permit this expansion. The sealing properties of the valve will not be compromised by such an arrangement.

Alternatively, or in addition to part of the vessel comprising a flexible material, the vessel may comprise a means of relieving pressure within the container when a hot fluid is sealed within the vessel. A wide variety of such means is known and may include, for example, a safety valve located on the closure device or vessel. The safety valve may be located on the valve disc itself. The safety valve may, for example, be a silicon safety valve.

Features disclosed in the context of each of the figures can also be combined to form other embodiments not illustrated here within the scope of protection defined by the claims.

References herein to fluid are intended to cover any substance which can be placed in the vessel and poured therefrom, including for example liquids and powders or granulated substances.

In embodiments of the present invention such as those described above, it will be appreciated that the magnetic force attracting the valve member to a valve seat may be generated by using a magnetic material (which produces a magnetic field) in the manufacture of the valve member. The valve seats may then be made of a material attracted by a magnet, such as steel. The valve seats may themselves be made of a magnetic material, in which case the valve member need not then be of a magnetic material but merely of a material attracted by a magnetic force (such as steel).

In use of the present invention, it should also be understood that a vessel may be filled or refilled with the valve member initially in the closed position and without removing a closure of the vessel. The liquid (or other pourable material, such as granulated solids) to be used in filling the vessel may be poured onto the top of the valve member so that the weight of the liquid overcomes the force retaining the valve member in the closed position and moves the valve member to the open position thereby allowing access to the interior of the vessel. The liquid may then flow into the interior of the vessel. This feature is particularly useful in topping-up drinks containers.

The invention claimed is:

1. A closure device for a fluid vessel, the closure device comprising a bistable valve through which a liquid exits the vessel, the bistable valve comprising a valve member and first and second valve seats, the valve member having an open position in which the liquid is permitted to exit the vessel and a closed position in which the liquid is substantially prevented from exiting the vessel, wherein a first magnetic force attracts the valve member to the second valve seat thereby holding the valve member in the open position, wherein the valve member closes in response to the liquid inside the vessel pressing against the valve member sufficiently to overcome the first magnetic force, and wherein the valve member is retained in the closed position by a second magnetic force.

2. The closure device according to claim 1, wherein the valve member engages the first valve seat in the closed position.

3. The closure device according to claim 1, wherein the valve member engages the second valve seat in the open position.

4. The closure device according to claim 1, wherein the first valve seat is above the second valve seat when the vessel is upright, and wherein the first valve seat delimits the closed position of the valve member, and the second valve seat delimits the open position of the valve member.

5. The closure device according to claim 1, wherein the valve member is a unitary moving part.

6. The closure device according to claim 1, wherein the first valve seat is located on a removable lid of the fluid vessel and the second valve seat is located on a main part of the fluid vessel.

7. The closure device according to claim 1, wherein the first valve seat comprises a first valve rim portion and the second valve seat comprises a second valve rim portion, and wherein the valve member selectively engages the first and second valve rim portions.

8. The closure device according to claim 7, wherein each valve rim portion is formed, at least in part, around an inner circumference of the vessel.

9. The closure device according to claim 7, wherein the closure device comprises a gasket which the valve member sealingly engages in the closed position.

10. The closure device according to claim 7, wherein in the open position, an opening is defined between the valve member and the second valve rim portion which extends substantially around the circumference of the vessel.

11. The closure device according to claim 1, wherein the valve member comprises a magnetic material.

12. The closure device according to claim 1, wherein a greater force is required to move the valve member from the closed position than is required to move the valve member from the open position.

13. A closure device for a fluid vessel, the closure device comprising a bistable valve through which a liquid exits the vessel, the bistable valve comprising a valve member and first and second valve seats, the valve member having an open position in which the liquid can exit the vessel and a closed position in which the liquid is substantially prevented from exiting the vessel, wherein the valve member comprises a disc, wherein a magnetic force attracts the valve member to the second valve seat thereby holding the valve member in the open position, and wherein the bistable valve closes in response to the liquid inside the vessel pressing against the valve member sufficiently to overcome the magnetic force.

14. The closure device according to claim 13, wherein the disc comprises a plastics material impregnated with magnetic material.

15. The closure device according to claim 8, wherein the valve member comprises a dome-like raised protrusion on an upper surface of the valve member.

16. The closure device according to claim 1, wherein the device comprises a pressure relief valve.

17. A fluid vessel comprising a closure device, the closure device comprising a bistable valve through which a liquid exits the vessel, the bistable valve comprising a valve member, the valve member having an open position in which the liquid is permitted to exit the vessel and a closed position in which the liquid is substantially prevented from exiting the vessel, wherein an attractive magnetic force holds the valve member in the open position, wherein the valve member closes in response to the liquid inside the vessel pressing against the valve member sufficiently to overcome the attractive magnetic force, and wherein the valve member is retained in the closed position by a second magnetic force.

* * * * *